United States Patent [19]

Turnage

[11] Patent Number: 4,570,790

[45] Date of Patent: Feb. 18, 1986

[54] FOLDING CARTON AND BLANK THEREFOR, FOR CIGARETTES

[75] Inventor: William E. Turnage, Midlothian, Va.

[73] Assignee: Philip Morris Incorporated, New York, N.Y.

[21] Appl. No.: 705,366

[22] Filed: Feb. 25, 1985

[51] Int. Cl.[4] ..... B65D 5/72

[52] U.S. Cl. ..... 206/263; 206/268; 206/273; 229/17 R; 229/33; 229/44 CB

[58] Field of Search ..... 206/268, 271, 273, 263; 229/16 A, 17 R, 33, 36, 44 R, 44 CB

[56] References Cited

U.S. PATENT DOCUMENTS

| | | | |
|---|---|---|---|
| 356,244 | 1/1887 | Emery | 229/44 CB |
| 1,916,119 | 6/1933 | Schwartz et al. | 229/36 |
| 1,950,740 | 3/1934 | Muller | 206/268 |
| 2,113,277 | 4/1938 | Muller | 206/273 |
| 2,120,258 | 6/1938 | Moore | 206/273 |
| 2,894,619 | 7/1959 | Gallo . | |
| 2,947,413 | 8/1960 | Tuomala et al. . | |
| 2,950,060 | 8/1960 | Von Rudeen | 229/44 |
| 3,052,398 | 9/1962 | Benjamin | 229/20 |
| 3,058,646 | 10/1962 | Guyer | 229/44 |
| 3,102,675 | 9/1963 | Schrom | 229/20 |
| 3,165,249 | 1/1965 | Peck | 225/43 |
| 3,245,525 | 4/1966 | Shoemaker . | |
| 3,342,399 | 9/1967 | Reynolds | 229/33 |
| 3,596,823 | 8/1971 | Zitzelman | 206/273 |
| 3,645,382 | 2/1972 | Abrams | 206/45.21 |
| 3,881,599 | 5/1975 | Flaherty | 206/273 |
| 4,050,622 | 9/1977 | Shimada et al. | 229/44 CB |

FOREIGN PATENT DOCUMENTS

| | | | |
|---|---|---|---|
| 0023397 | 4/1930 | Australia | 229/44 CB |
| 2408879 | 9/1975 | Fed. Rep. of Germany | 206/268 |
| 0530316 | 12/1940 | United Kingdom | 206/268 |
| 1335683 | 10/1973 | United Kingdom . | |
| 1448629 | 9/1976 | United Kingdom . | |

*Primary Examiner*—William T. Dixson, Jr.
*Assistant Examiner*—Jimmy G. Foster
*Attorney, Agent, or Firm*—Jeffrey H. Ingerman

[57] ABSTRACT

A paperboard cigarette pack resembling a cigarette case is provided. The pack has a caddy member and a cover member hinged to the caddy member along one side. The cover member folds over the caddy member in nesting engagement.

10 Claims, 7 Drawing Figures

FIG. 1
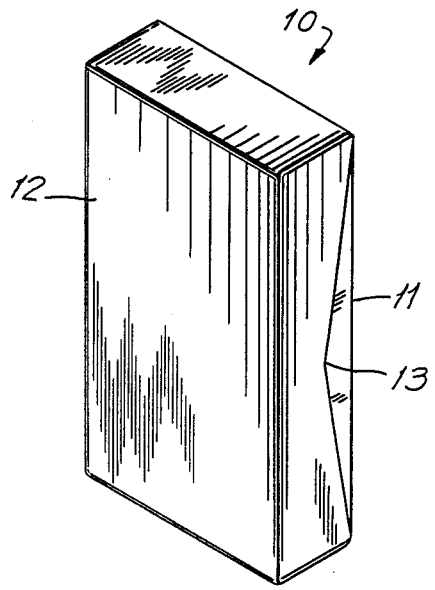
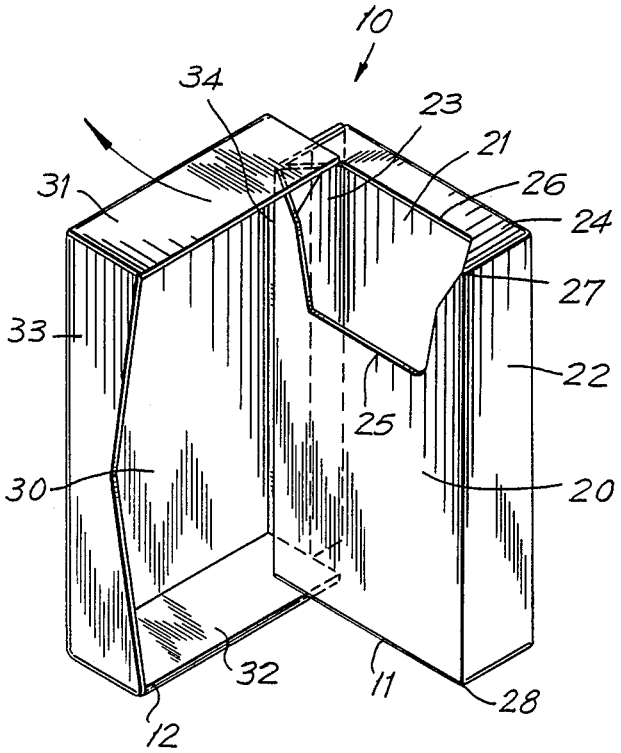
FIG. 2

FOLDING CARTON AND BLANK THEREFOR, FOR CIGARETTES

BACKGROUND OF THE INVENTION

This invention relates to folding cartons and blanks therefor, particularly to cigarette packs, and more particularly to a cigarette box having a side-hinged lid.

Cigarettes are typically sold in packs of twenty to twenty-five cigarettes. Two types of packs are in general use. The first type is the "soft pack," which is a bundle of cigarettes wrapped in foil, overwrapped with a paper wrapper which usually has brand and other information printed on its outer side, and overwrapped again with a sealed transparent film overwrap. The second type is the "box" or "FLIP-TOP ® box," which is a hard paperboard box containing a foil-wrapped cigarette bundle and having a hinged lid at the top and a sealed transparent film overwrap. Typically, a paperboard insert surrounds the bundle at least near the top of the box providing a frictional engagement surface to retain the lid in the closed position when desired. A cutout in this insert allows a smoker to remove cigarettes from the box.

Each type of pack has its own advantages and disadvantages. The soft pack collapses as cigarettes are removed from it, taking up less space in a smoker's pocket or purse as the contents are smoked, while providing an approximate external indication of the number of cigarettes remaining in the pack. However, once the transparent film overwrap of a soft pack is opened, it cannot be reclosed. As a result, any loose tobacco in the pack may eventually drop from the pack into the smoker's pocket or purse. The cigarettes can also be damaged if the pack is roughly handled. For these reasons, many smokers prefer the FLIP-TOP ® box, which can be reclosed to prevent loose tobacco from dropping out, and which offers better protection for the cigarettes within it.

SUMMARY OF THE INVENTION

It is an object of this invention to provide a cigarette pack which will prevent the dropping out of loose tobacco.

It is also an object of this invention to provide a cigarette pack of increased attractiveness to smokers.

In accordance with the invention, a folding carton is provided which has the appearance and attractiveness of a cigarette case. The carton has a caddy member and a cover member. The caddy member is of a solid rectangular shape and has a height approximately the length of a cigarette, a width approximately an integral multiple of the diameter of a cigarette, and a depth sufficient to accommodate a plurality of rows of cigarettes. The caddy member has front and back walls defined by the height and the width, top and bottom walls defined by the width and the depth, and side walls defined by the height and the depth. The front wall and the top wall each have a cutout portion along their common edge, the cutout portions together forming an opening for the withdrawal of cigarettes. The cover member is attached by a hinge to a side wall of the caddy member and nestingly engages the front, side, top and bottom walls of the caddy member.

Preferably, the caddy member and the cover member are erected from separate blanks, but they can also be erected from a single blank. The cover member is also preferably notched to allow the smoker to grasp the caddy member while opening the cover.

BRIEF DESCRIPTION OF THE DRAWINGS

The above and other objects and advantages of the invention will be apparent from consideration of the following detailed description, taken in conjunction with the accompanying drawings, in which like reference characters refer to like parts throughout, and in which:

FIG. 1 is a front perspective view of a preferred embodiment of a cigarette pack according to the invention in the closed position;

FIG. 2 is a front perspective view of the cigarette pack of FIG. 1 in the open position (without a cigarette bundle);

DETAILED DESCRIPTION OF THE INVENTION

Figure 3:
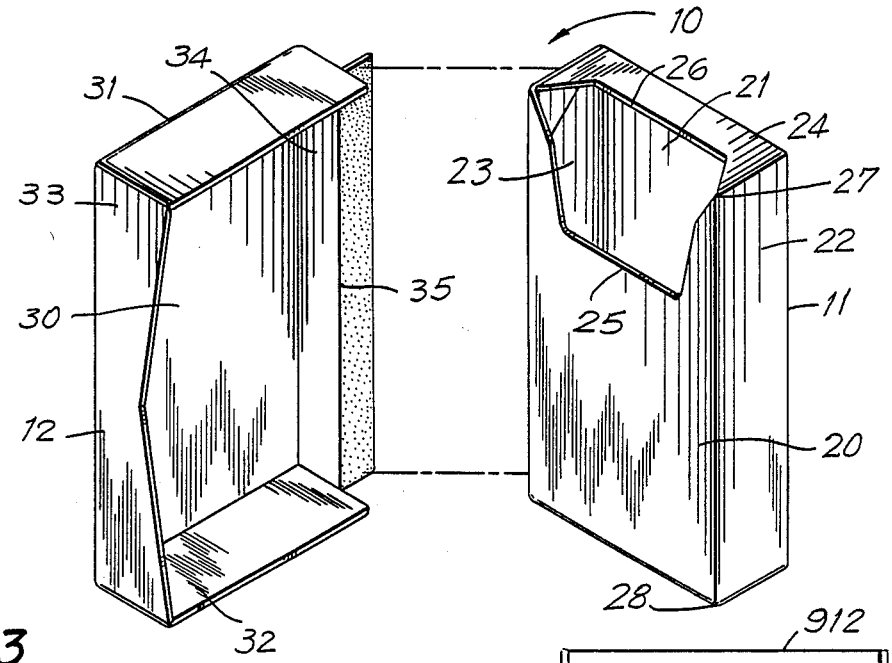
FIG. 3 is an exploded perspective view of the cigarette pack of FIG. 2 showing the caddy and cover members (without a cigarette bundle)

A preferred embodiment of the cigarette pack of the present invention is shown in FIGS. 1–3. Cigarette pack 10 includes a caddy member 11 and a cover member 12 and, when closed, is similar in size and shape to known cigarette packs. Caddy member 11 differs from known FLIP-TOP ® boxes in the absence of the lid, and has a front wall 20, back wall 21, side walls 22, 23, top wall 24, and a bottom wall (not shown). Cutout portions 25 in front wall 20, and 26 in top wall 24, form an opening for the removal of cigarettes from caddy member 11.

Cover member 12 has a front wall 30, top and bottom walls 31, 32, and side walls 33, 34 and nestingly engages caddy member 11. Cover member 12 is attached by hinge 35 at the vertical center line of side 23 of caddy member 11.

As seen in FIG. 1, cigarette pack 10 resembles an ordinary FLIP-TOP ® box in size and shape when cover member 12 is closed. Cover member 12 is retained in the closed position by the frictional engagement of corners 27, 28 of caddy member 11 with the interior of side wall 33 of cover member 12. A triangular notch 13 is provided in cover member 12 to allow caddy member 11 to be grasped for opening cigarette pack 10.

When open, as seen in FIG. 2, cigarette pack 10 resembles a cigarette case, increasing its attractiveness to smokers. At the same time, when closed, cigarette pack 10 is effective in preventing the dropping out of loose tobacco into a smoker's pocket or purse.

Figure 4:
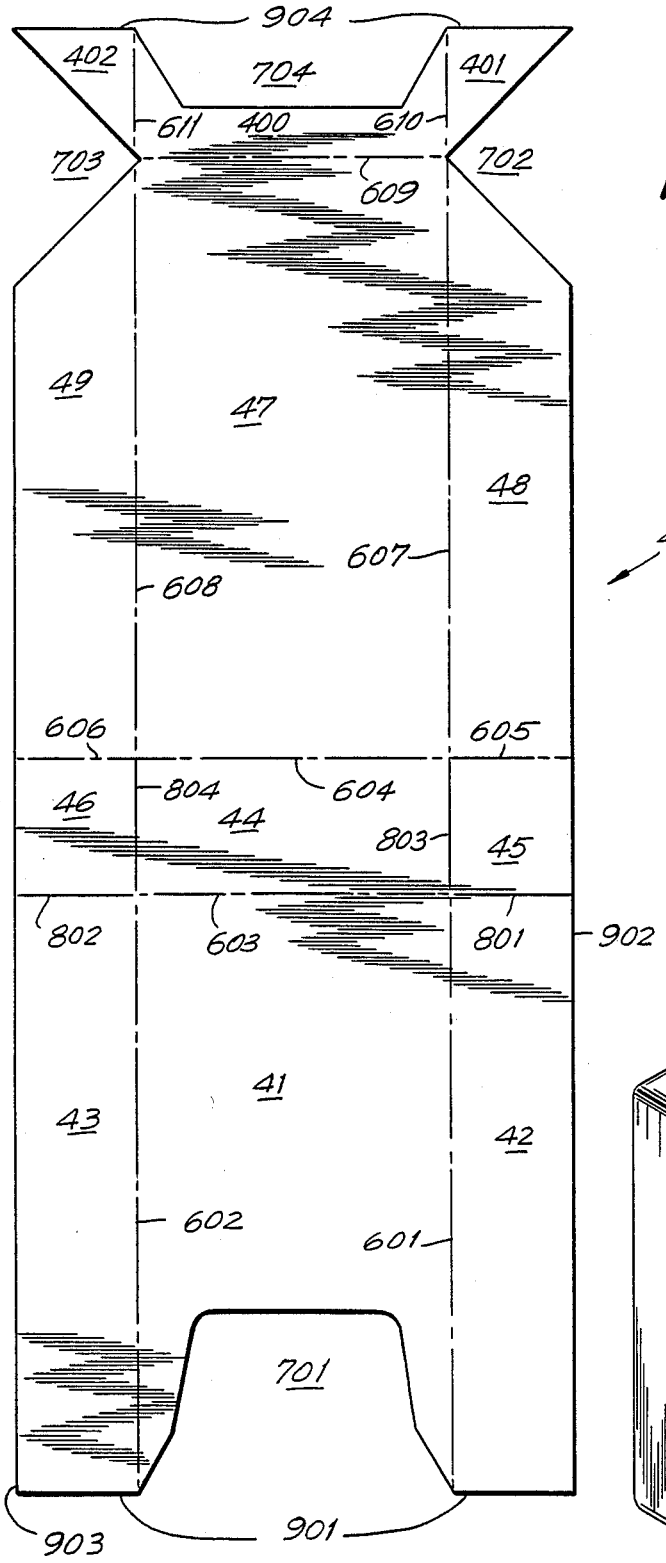
FIG. 4 is a plan view of a caddy member blank according to a preferred embodiment of the invention.

A paperboard blank 40 from which caddy member 11 is erected is shown in FIG. 4. Blank 40 has a front wall panel 41 defined by parallel long front-defining score lines 601, 602, short front-defining score line 603, and front cutout portion 701. A first outer side wall panel 42 is defined by score line 601, cut 801 and edges 901, 902 of blank 40. A second outer side wall panel 43 is defined by score line 602, cut 802, and edges 901, 903 of blank 40. A bottom wall panel 44 is defined by score line 603, bottom-defining score line 604, and cuts 803, 804. A back wall panel 47 is defined by score line 604, parallel long back-defining score lines 607, 608, and short back-defining score line 609. A first inner side wall panel 48 is defined by score line 607, first side-defining score line 605, cutout 702, and edge 902 of blank 40. A second inner side wall panel 49 is defined by score line 608, second side-defining score line 606, cutout 703, and edge 903 of blank 40. A first bottom closure tab 45 is defined by cuts 801, 803, score line 605, and edge 902 of blank 40. A second bottom closure tab 46 is defined by cuts 802, 804, score line 606, and edge 903 of blank 40. A top wall panel 400 is defined by score line 609, parallel top-defining score lines 610, 611 and to cutout portion 704. A first top closure tab 401 is defined by score line 610, cutout 702, and edge 904 of blank 40. A second top closure tab 402 is defined by score line 611, cutout 703, and edge 904 of blank 40.

Figure 5:
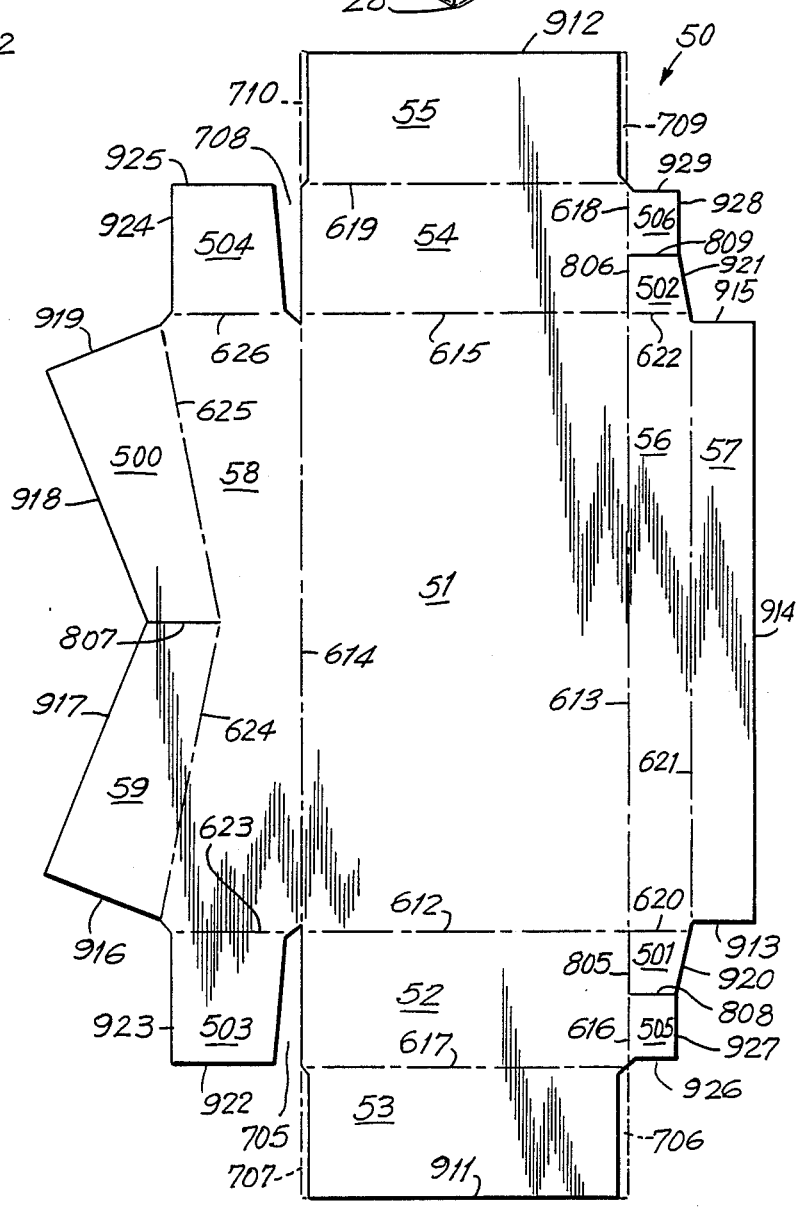
FIG. 5 is a plan view of a cover member blank according to a preferred embodiment of the invention.

A paperboard blank 50 from which cover member 12 is erected is shown in FIG. 5. A face panel 51 is defined by parallel long face-defining score lines 613, 614, and parallel short face-defining score lines 612, 615 perpendicular to score lines 613, 614. An outer bottom skirt panel 52 is defined by score line 612, short bottom skirt-defining score line 616, long bottom short-defining score line 617, cut 805, and cutout 705. An inner bottom skirt panel 53 is defined by score line 617, cutouts 706, 707 (both shown in phantom), and edge 911 of blank 50. An outer top skirt panel 54 is defined by score line 615, short top skirt-defining score line 618, long top skirt-defining score line 619, cut 806 and cutout 708. An inner top skirt panel 55 is defined by score line 619, cutouts 709, 710 (both shown in phantom), and edge 912 of blank 50. A hinge panel 56 is defined by score line 613 and is divided by hinge-dividing score line 621 into swinging panel 56 and stationary panel 57. Swinging panel 56 is defined by score lines 613, 621, and by parallel swing-defining score lines 620, 622. Stationary panel 57 is defined by score line 621 and edges 913, 914, 915 of blank 50. An outer side skirt panel 58 is defined by score line 614, parallel outer side skirt-defining score lines 623, 626 perpendicular to score line 614, and obliquely intersecting outer side skirt-defining score lines 624, 625. An inner side skirt panel 59 is defined by score line 624, cut 807, and perpendicular edges 916, 917 of blank 50. Another inner side skirt panel 500 is defined by score line 625, cut 807, and perpendicular edges 918, 919 of blank 50. Panels 59, 500 are identical quadrilaterals each having four sides of different lengths, two of which are perpendicular. A bottom swinging panel closure tab 501 is defined by score line 620, cuts 805, 808, and edge 920 of blank 50. A top swinging panel closure tab 502 is defined by score line 622, cuts 806, 809, and edge 921 of blank 50. A bottom side closure tab 503 is defined by score line 623, cutout 705, and edges 922, 923 of blank 50. A top side closure tab 504 is defined by score line 626, cutout 708, and edges 924, 925 of blank 50. A bottom closure tab 505 is defined by score line 616, cut 808, and edges 926, 927 of blank 50. A top closure tab 506 is defined by score line 618, cut 809, and edges 928, 929 of blank 50.

As shown in FIGS. 2 and 3, stationary panel 57 of blank 50 is adhered to a portion of side wall 23 of caddy member 11, with score line 621 functioning as hinge 35.

Figure 6:
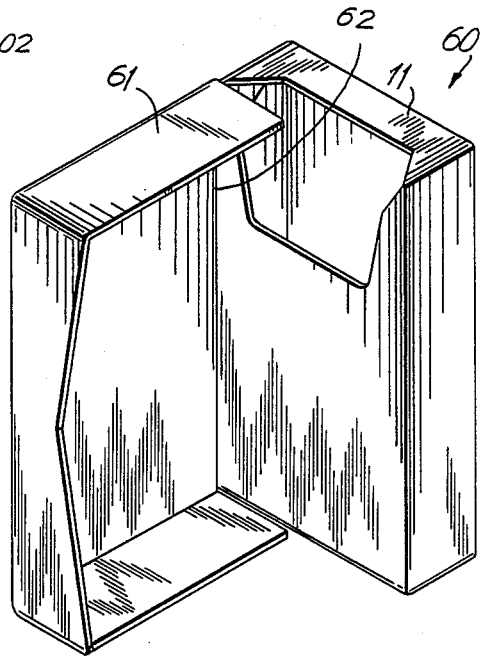
FIG. 6 is a front perspective view of an alternate embodiment of the invention in the open position (without a cigarette bundle)

In an alternate embodiment 60 shown in FIG. 6, cover member 61 is hinged to caddy member 11 at corner 62. Cigarette pack 60 can be formed from two separate members as is cigarette pack 10. For example, blank 50 can be modified by eliminating score line 621 and cuts 808 and 809, changing score lines 620 and 622 to cuts, and changing cuts 805 and 806 to score lines, and then adhering the entire hinge panel 560 to side 23 of caddy member 11, with score line 613 functioning as hinge 62.

Figure 7:
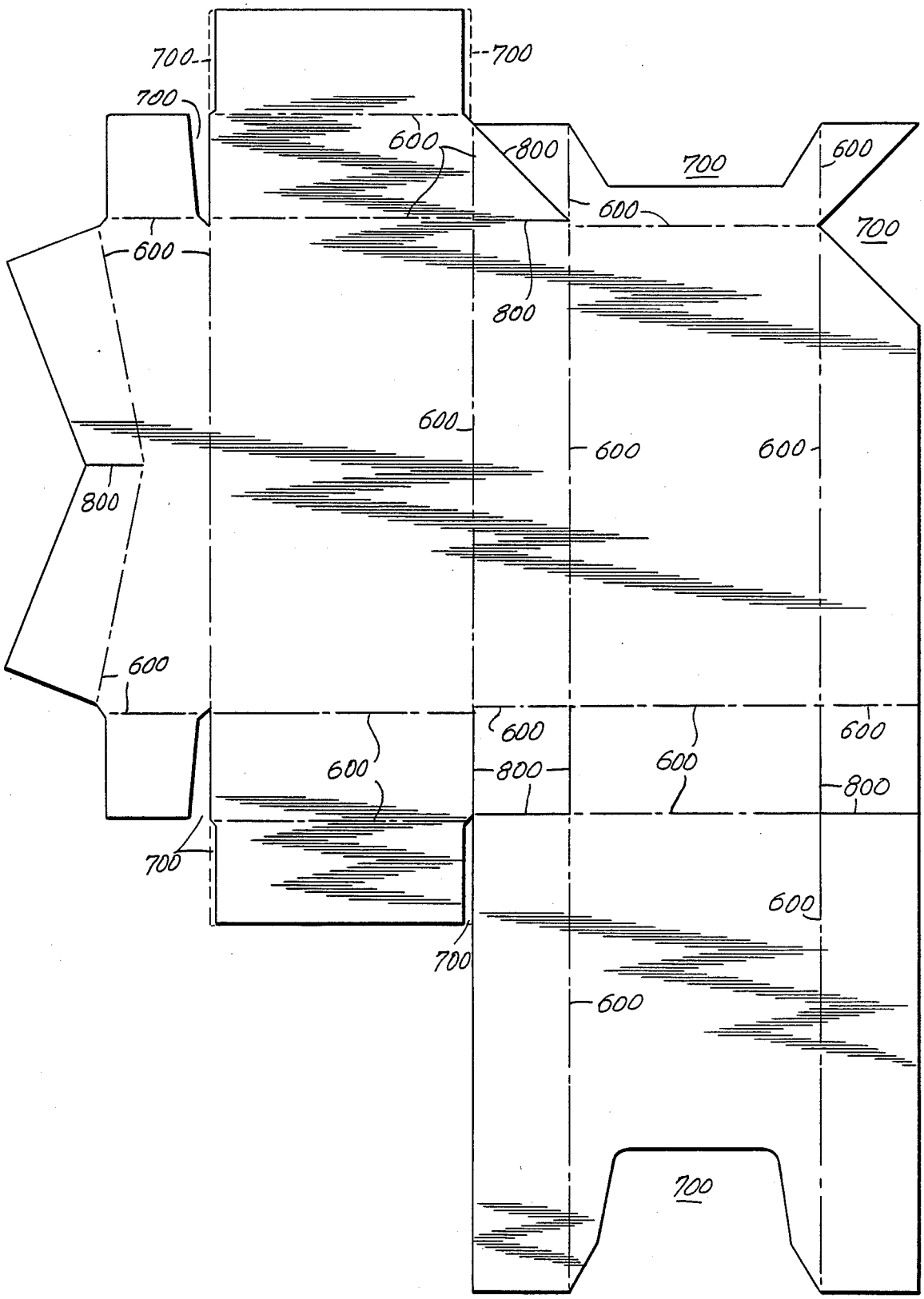
FIG. 7 is a plan view of a blank for the embodiment of FIG. 6.

Cigarette pack 60 can also be formed from a single blank such as that shown in FIG. 7, in which all score lines are marked 600, all cutouts are marked 700, and all cuts are marked 800.

The cigarette pack described herein provides a closed container which prevents the dropping out of loose tobacco. It is also attractive to smokers as it simulates a cigarette case. The exterior of the pack can be printed with brand and other information and with decorative material in the same manner as other cigarette packs. Similarly, the cigarettes contained within the pack can be wrapped in foil in the manner known to those in art, and the pack can be conventionally overwrapped with a transparent film overwrap to keep the cigarettes fresh.

It will be apparent to those skilled in the art that the invention described herein can be practiced by other than the embodiments described above, which are presented for the purpose of illustration and not of limitation, and the present invention is limited only by the claims which follow.

What is claimed is:

1. A folding carton comprising:

a caddy member, said caddy member having a solid rectangular shape, and having a height approximately the length of a cigarette, a width approximately an integral multiple of the diameter of a cigarette, and a depth sufficient to accommodate a plurality of rows of cigarettes, said caddy member further having a front wall and a back wall each defined by said height and said width, a top wall and a bottom wall each defined by said width and said depth, and first and second side walls each defined by said height and said depth, said front wall and said top wall each having a cutout portion along the edge common to both said walls, said cutout portions together forming an opening through which cigarettes may be withdrawn; and a cover member attached to said first side wall of said caddy member by a hinge, said cover member nestingly engaging said front, top, bottom, and side walls of said caddy member.

2. The folding carton of claim 1 wherein the portion of said cover engaging said second side wall has a notched portion whereby the caddy member can be grasped for opening said cover member.

3. The folding carton of claim 1 wherein said cover member is hinged to said caddy member along the vertical center line of said first side wall.

4. The folding carton of claim 1 wherein said cover member is hinged to said caddy member where said first side wall meets said front wall.

5. The folding carton of claim 3 wherein said caddy member is erected from a first blank and said cover member is erected from a second blank.

6. The folding carton of claim 5 wherein said first blank comprises:

a front wall panel defined by a pair of parallel long front-defining score lines, a short front-defining score line perpendicular to said long front-defining score lines, and a front cutout portion;

a first outer side wall panel connected to said front wall panel along one of said long front-defining score lines;

a second outer side wall panel connected to said front wall panel along the other of said long front-defining score lines;

a bottom wall panel connected to said front wall panel along said short front-defining score line, and further defined by a bottom-defining score line parallel to said short front-defining score line;

a back wall panel connected to said bottom wall panel along said bottom-defining score line, and further defined by a pair of parallel long back-defining score lines perpendicular to said bottom-defining score line and a short back-defining score line perpendicular to said long back-defining score lines;

a first inner side wall panel connected to said back wall panel along one of said long back-defining score lines and further defined by a first side-defining score line perpendicular to said one of said long back-defining score lines;

a second inner side wall panel connected to said back wall panel along the other of said long back-defining score lines and further defined by a second side-defining score line perpendicular to said other of said long back-defining score lines;

a top wall panel connected to said back wall panel along said short back-defining score line and further defined by a pair of parallel top-defining score lines perpendicular to said short back-defining score line and by a top cutout portion, said top cutout portion adjoining said front cutout portion when said first blank is erected;

a first bottom closure tab connected to said first inner said wall panel along said first side-defining score line;

a second bottom closure tab connected to said second inner side wall panel along said second side-defining score line;

a first top closure tab connected to said top wall panel along one of said top-defining score lines; and a second top closure tab connected to said top wall panel along the other of said top-defining score lines.

7. The folding carton of claim 5 wherein said second blank comprises:

a face panel defined by a pair of parallel long face-defining score lines and a pair of parallel short face-defining score lines perpendicular to said long face-defining score lines;

an outer bottom skirt panel connected to said face panel along one of said short face-defining score lines, and further defined by a short outer bottom skirt-defining score line and a long outer bottom skirt-defining score line perpendicular to said short outer bottom skirt-defining score line;

an outer top skirt panel connected to said face panel along the other of said short face-defining score lines, and further defined by a short outer top skirt-defining score line and a long outer top skirt-defining score line perpendicular to said short outer top skirt-defining score line;

an outer bottom skirt panel connected to said outer bottom skirt panel along said long outer bottom skirt-defining score line;

an inner top skirt panel connected to said outer top skirt panel along said long outer top skirt-defining score line;

a hinge panel connected to said face panel along one of said long face-defining score lines, said hinge panel being divided by a hinge-dividing score line into a swinging panel and a stationary panel, said swinging panel being further defined by a pair of parallel swing-defining score lines;

an outer side skirt panel connected to said face panel along the other of said long face-defining score lines, said outer side skirt panel having a concave pentagonal shape and being further defined by a pair of parallel outer side skirt-defining score lines perpendicular to said other of said long face-defining score lines, and by a pair of obliquely intersecting outer side skirt-defining score lines;

a pair of inner side skirt panels, each of said inner side skirt panels having the shape of a quadrilateral having four sides of different lengths, two of said sides being perpendicular, each of said inner side skirt panels being connected to said outer side skirt panel along one of said obliquely intersecting outer said skirt-defining score lines;

a top side closure tab connected to said outer side skirt panel along one of said parallel outer side skirt-defining score lines;

a bottom side closure tab connected to said outer side skirt panel along the other of said parallel outer side skirt-defining score lines;

a top closure tab connected to said outer top skirt panel along said short outer top skirt-defining score line;

a bottom closure tab connected to said outer bottom skirt panel along said short outer bottom skirt-defining score line;

a top swinging panel closure tab connected to said swinging panel along one of said parallel swing-defining score lines; and a bottom swinging panel closure tab connected to said swinging panel along the other of said parallel swing-defining score lines;

a bottom side closure tab connected to said outer side skirt panel along the other of said parallel outer side skirt-defining score lines;

a top closure tab connected to said outer top skirt panel along said short outer top skirt-defining score line;

a bottom closure tab connected to said outer bottom skirt panel along said short outer bottom skirt-defining score line;

a top swinging panel closure tab connected to said swinging panel along one of said parallel swing-defining score lines; and a bottom swinging panel closure tab connected to said swinging panel along the other of said parallel swing-defining score lines.

8. The folding carton of claim 5 wherein said first blank comprises:

a front wall panel defined by a pair of parallel long front-defining score lines, a short front-defining score line perpendicular to said long front-defining score lines, and a front cutout portion;

a first outer side wall panel connected to said front wall panel along one of said long front-defining score lines;

a second outer side wall panel connected to said front wall panel along the other of said long front-defining score lines;

a bottom wall panel connected to said front wall panel along said short front-defining score line, and further defined by a bottom-defining score line parallel to said short front-defining score line;

a back wall panel connected to said bottom wall panel along said bottom-defining score line, and further defined by a pair of parallel long back-defining score lines perpendicular to said botton-defining score line and a short back-defining score line perpendicular to said long back-defining score lines;

a first inner side wall panel connected to said back wall panel along one of said long back-defining score lines and further defined by a first side-defining score line perpendicular to said one of said long back-defining score lines;

a second inner side wall panel connected to said back wall panel along the other of said long back-defining score lines and further defined by a second side-defining score line perpendicular to said other of said long back-defining score lines;

a top wall panel connected to said back wall panel along said short back-defining score line and further defined by a pair of parallel top-defining score lines perpendicular to said short back-defining score line and by a top cutout portion, said top cutout portion adjoining said front cutout portion when said first blank is erected;

a first bottom closure tab connected to said first inner said wall panel along said first side-defining score line;

a second bottom closure tab connected to said second inner side wall panel along said second side-defining score line;

a first top closure tab connected to said top wall panel along one of said top-defining score lines; and a second top closure tab connected to said top wall panel along the other of said top-defining score lines; and said second blank comprises:

a face panel defined by a pair of parallel long face-defining score lines and a pair of parallel short face-defining score lines perpendicular to said long face-defining score lines;

an outer bottom skirt panel connected to said face panel along one of said short face-defining score lines, and further defined by a short outer bottom skirt-defining score line and a long outer bottom skirt-defining score line perpendicular to said short outer bottom skirt-defining score line;

an outer top skirt panel connected to said face panel along the other of said short face-defining score lines, and further defined by a short outer top skirt-defining score line and a long outer top skirt-defining score line perpendicular to said short outer top skirt-defining score line;

an outer bottom skirt panel connected to said outer bottom skirt panel along said long outer bottom skirt-defining score line;

an inner top skirt panel connected to said outer top skirt panel along said long outer top skirt-defining score line;

a hinge panel connected to said face panel along one of said long face-defining score lines, said hinge panel being divided by a hinge-dividing score line into a swinging panel and a stationary panel, said swinging panel being further defined by a pair of parallel swing-defining score lines;

an outer side skirt panel connected to said face panel along the other of said long face-defining score lines, said outer side skirt panel having a concave pentagonal shape and being further defined by a pair of parallel outer side skirt-defining score lines perpendicular to said other of said long face-defining score lines, and by a pair of obliquely intersecting outer side skirt-defining score lines;

a pair of inner side skirt panels, each of said inner side skirt panels having the shape of a quadrilateral having four sides of different lengths, two of said sides being perpendicular, each of said inner side skirt panels being connected to said outer side skirt panel along one of said obliquely intersecting outer said skirt-defining score lines;

a top side closure tab connected to said outer side skirt panel along one of said parallel outer side skirt-defining score lines;

a bottom side closure tab connected to said outer side skirt panel along the other of said parallel outer side skirt-defining score lines;

a top closure tab connected to said outer top skirt panel along said short outer top skirt-defining score line;

a bottom closure tab connected to said outer bottom skirt panel along said short outer bottom skirt-defining score line;

a top swinging panel closure tab connected to said swinging panel along one of said parallel swing-defining score lines; and a bottom swinging panel closure tab connected to said swinging panel along the other of said parallel swing-defining score lines; wherein said stationary panel is adhered to at least a portion of said first outer side wall panel when said blanks are erected; and said hinge-defining score line is said hinge.

9. The folding carton of claim 4 wherein said caddy member and said cover member are erected from one blank.

10. The folding carton of claim 4 wherein said caddy member is erected from a first blank and said cover member is erected from a second blank.

* * * * *